US007750929B2

(12) United States Patent
Fujiwara

(10) Patent No.: US 7,750,929 B2
(45) Date of Patent: Jul. 6, 2010

(54) METHOD FOR CONTROLLING IMAGE FORMING APPARATUS

(75) Inventor: Motohiro Fujiwara, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 385 days.

(21) Appl. No.: 11/696,340

(22) Filed: Apr. 4, 2007

(65) Prior Publication Data

US 2007/0237532 A1 Oct. 11, 2007

(30) Foreign Application Priority Data

Apr. 6, 2006 (JP) ..... 2006-105383
Jan. 26, 2007 (JP) ..... 2007-016426

(51) Int. Cl.
*B41J 2/385* (2006.01)
*B41J 2/47* (2006.01)

(52) U.S. Cl. ..... 347/140; 347/228

(58) Field of Classification Search ..... 347/246, 347/240, 251–254, 131, 140, 228; 399/49
See application file for complete search history.

(56) References Cited

U.S. PATENT DOCUMENTS 4,855,766 A * 8/1989 Suzuki ..... 347/246
5,579,090 A 11/1996 Sasanuma et al.
7,251,422 B2 * 7/2007 Tokuyama et al. ..... 399/49
2007/0177231 A1 * 8/2007 Wang et al. ..... 358/504

FOREIGN PATENT DOCUMENTS

JP 7-264427 10/1995
JP 10073975 A * 3/1998
JP 10-239924 9/1998

* cited by examiner

*Primary Examiner*—Hai C Pham
(74) *Attorney, Agent, or Firm*—Canon U.S.A., Inc. I.P. Division

(57) ABSTRACT

An electrostatic latent image is formed by controlling the amount of light, the emission time, and the like, considering the spot diameters of a laser, without changing the charging bias, the developing bias, and the like so as to obtain a plurality of correlations between density patches and development contrasts faithfully representing the developing characteristics of an image forming apparatus in a short time.

3 Claims, 12 Drawing Sheets

LASER DRIVE PULSE

REFERENCE CLOCK PULSE

NUMBER OF CLOCK PULSES

ELECTROSTATIC LATENT IMAGE

FIG. 6A
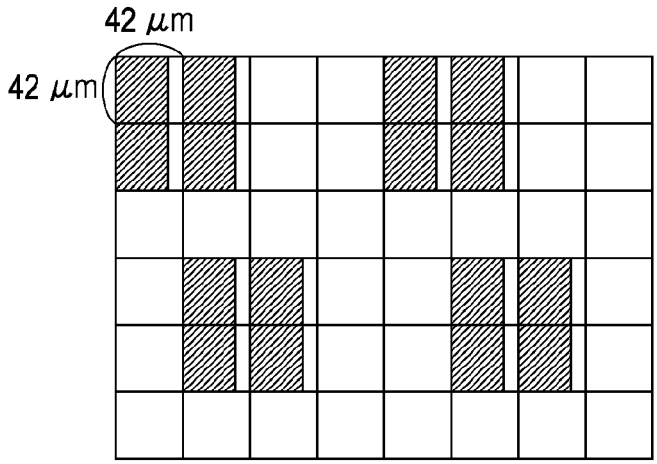
FIG. 6B
| | | | | | | | |
|---|---|---|---|---|---|---|---|
| 70% | 70% | 0% | 0% | 70% | 70% | 0% | 0% |
| 70% | 70% | 0% | 0% | 70% | 70% | 0% | 0% |
| 0% | 0% | 0% | 0% | 0% | 0% | 0% | 0% |
| 0% | 0% | 70% | 70% | 0% | 70% | 70% | 0% |
| 0% | 0% | 70% | 70% | 0% | 70% | 70% | 0% |
| 0% | 0% | 0% | 0% | 0% | 0% | 0% | 0% |
FIG. 7
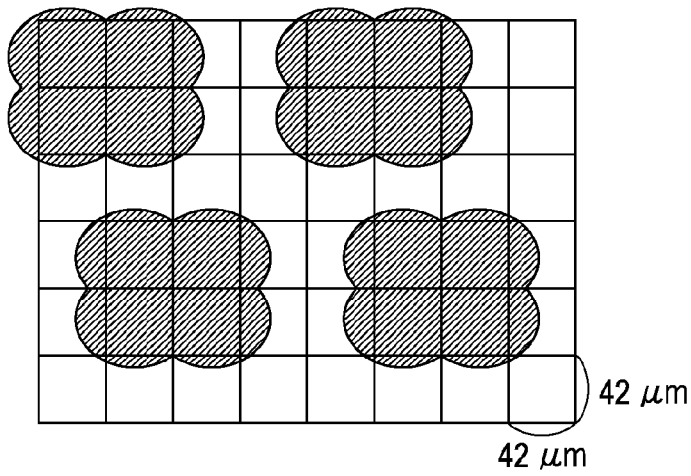

METHOD FOR CONTROLLING IMAGE FORMING APPARATUS

BACKGROUND OF THE INVENTION

1. Field of the Invention

The present invention relates to a method for controlling an image forming apparatus that forms an electrostatic latent image by irradiating the charged surface of a photosensitive body with a laser beam to form an image.

2. Description of the Related Art

An electrophotographic image forming apparatus includes a charging unit that uniformly charges the photosensitive surface of an image bearing member (for example, a photosensitive drum), a latent-image forming unit that forms an electrostatic latent image corresponding to image information on the charged photosensitive surface, and a developing unit that develops the electrostatic latent image. The electrophotographic image forming apparatus further includes a transfer unit that transfers the electrostatic latent image developed with toner to a sheet of recording paper and successively forms images while rotating the photosensitive surface of the photosensitive drum.

In such an image forming apparatus, a change in image density, a change in tone reproduction, and the like occur under the influence of a short-term change due to a change in the environment in which the apparatus is placed, a change in the environment in the apparatus, and the like, and a long-term change due to a change (deterioration) of the photosensitive drum or toner over time. That is to say, in order to unify the density, tone reproduction, and the like of an output image, correction needs to be performed in view of these changes.

In view of these problems, a method is disclosed in Japanese Patent Laid-Open No. 7-264427 for effectively utilizing the maximum density that can be expressed in consideration of a deterioration of the maximum image density. Specifically, after the condition for forming an image is adjusted so as to be higher than a target maximum density, the transfer characteristic of a transformation unit that performs density transformation of input image data is adjusted. The following method exists for controlling the stability of densities in a high density range. A desired maximum density is obtained by obtaining a target value of the potential of the surface of a photosensitive drum on the basis of the correlation between contrast potentials and the densities of the maximum density patches of individual colors of yellow (Y), magenta (M), cyan (C), and black (Bk) and determining the charging bias and the developing bias.

Moreover, a technique is disclosed in Japanese Patent Laid-Open No. 10-239924. In this technique, for each of at least two combinations of charging biases and developing biases, a reference patch image that is generated under the same exposure conditions is formed on an image bearing member or another image medium while changing both of the charging bias and the developing bias at the same time. Then, the reference patch image is read, and the settings of the charging bias and the developing bias are determined on the basis of the read data.

In the method disclosed in Japanese Patent Laid-Open No. 7-264427, the stability of densities in a high density range is considered. However, since the charging bias and the developing bias are determined from the density of one patch, it is hard to perform precise correction.

Moreover, in the technique disclosed in Japanese Patent Laid-Open No. 10-239924, precise control can be performed by obtaining the correlation between the reference patch and the density while changing the charging bias and the developing bias. However, it takes long time to perform adjustment.

SUMMARY OF THE INVENTION

The present invention provides solutions to at least one of the aforementioned problems and another problem.

A method according to a first aspect of the present invention is provided for controlling an image forming apparatus that includes a charging unit that charges an image bearing member, an exposure unit that forms an electrostatic latent image on the charged image bearing member, and a developing unit that develops the electrostatic latent image. The method includes forming latent images at a plurality of density levels on the image bearing member and measuring potentials of the latent images at the plurality of density levels formed on the image bearing member; detecting densities of images obtained by developing the latent images at the plurality of density levels; controlling the charging unit and the developing unit; and performing control so as to form the latent images at the plurality of density levels with a spot having spot diameters such that the spot is larger than a unit pixel of the image forming apparatus when the exposure unit forms the latent images at the plurality of density levels.

In the control method according to the first aspect of the present invention, the amount of light, the emission time, and the like are controlled considering the spot diameters of a laser. Thus, a plurality of correlations between density patches and development contrasts faithfully representing the developing characteristics of an image forming apparatus can be obtained in a short time without changing the charging bias and the developing bias. Appropriate setting values of the charging bias and the developing bias can be obtained from the correlations, thus enabling precise control of a high density range.

Further features of the present invention will become apparent from the following description of exemplary embodiments with reference to the attached drawings.

BRIEF DESCRIPTION OF THE DRAWINGS

The accompanying drawings, which are incorporated in and constitute a part of the specification, illustrate an embodiment of the present invention and, together with the description, serve to explain the principles of the present invention.

FIGS. 6A and 6B show the ratio of time during which the semiconductor laser emits a laser beam to dwell time per pixel in an exemplary case where a latent image of the eighty-fifth level of 256-level (0 to 255 levels) tone reproduction is formed.

FIG. 7 shows a case where electrostatic latent images are formed on the photosensitive drum with the spot diameters of the semiconductor laser, which is used, being 43 μm and 50 μm.

DESCRIPTION OF THE EMBODIMENTS

Exemplary embodiments of the present invention will be described in detail below with reference to the drawings. In the exemplary embodiments, the case of a copying machine that includes a single photosensitive drum will be described. However, the present invention is not limited to such a copying machine that includes a single photosensitive drum, and, for example, individual image forming units for Y, M, C, and Bk may be disposed along the direction of conveying recording sheets.

In a method for controlling an image forming apparatus according to an exemplary embodiment, a latent image is formed with a laser spot that is larger than a unit pixel so that an electrostatic latent image that is not composed of isolated dots is formed. Thus, an appropriate potential can be set considering the characteristics of an image forming apparatus.

First Exemplary Embodiment

Image Forming Apparatus

Figure 1:
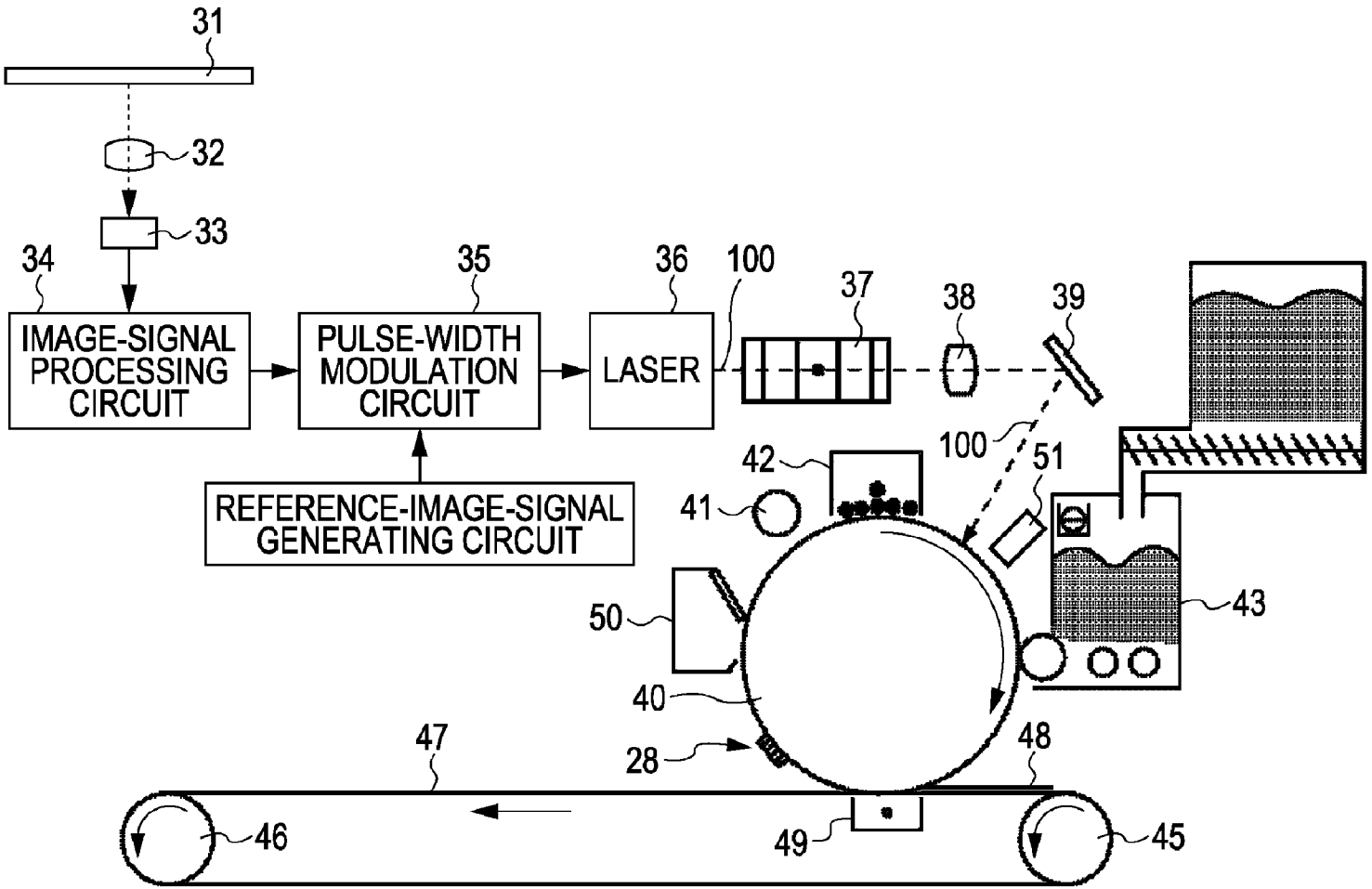
FIG. 1 is a longitudinal sectional view of an image forming apparatus according to an exemplary embodiment of the present invention.

FIG. 1 is a longitudinal sectional view showing the structure of an image forming apparatus according to an exemplary embodiment of the present invention. FIGS. 2A, 2B, 2C, and 2D are diagrams showing the relationships between laser drive pulses for driving a semiconductor laser and electrostatic latent images formed on an image bearing member.

Figure 2A:
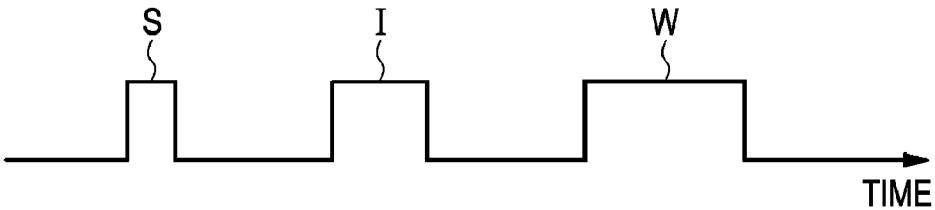
FIGS. 2A, 2B, 2C, and 2D are diagrams showing the relationships between laser drive pulses for driving a semiconductor laser and electrostatic latent images formed on an image bearing member.

In the image forming apparatus, an image of an original document 31 to be copied is projected onto an image pickup element 33, for example, a charge coupled device (CCD), as an optical image via a lens 32. The image pickup element 33 breaks the image of the original document 31 into pixels with a resolution of 600 dots per inch (dpi) and generates electrical signals by photoelectric conversion corresponding to the density of each of the pixels. Photoelectrically converted signals (analog image signals) output from the image pickup element 33 are input to an image-signal processing circuit 34. The image-signal processing circuit 34 converts the photoelectrically converted signals to pixel image signals (digital signals) having output levels corresponding to the densities of the individual pixels and outputs the pixel image signals to a pulse-width modulation circuit 35. The pulse-width modulation circuit 35 generates and outputs a laser drive pulse having a width (a time length) corresponding to the level of each of the input pixel image signals. That is to say, a drive pulse W having a relatively wide width is generated for a pixel image signal the level of which indicates a high density, a drive pulse S having a relatively narrow width is generated for a pixel image signal the level of which indicates a low density, and a drive pulse I having a medium width is generated for a pixel image signal the level of which indicates a medium density, as shown in FIG. 2A.

Figure 2B:
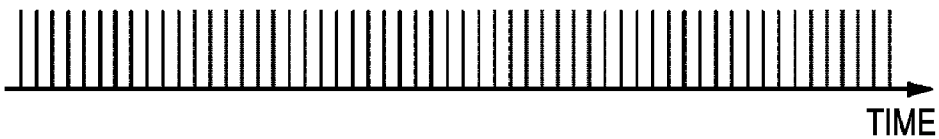
Figure 2C:
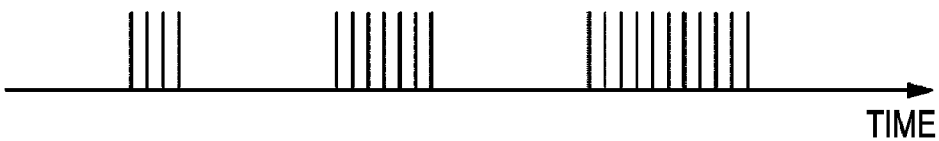
Figure 2D:
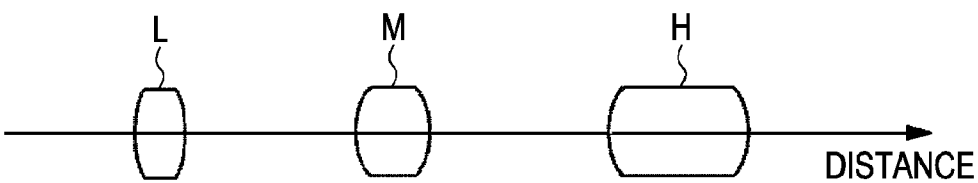

FIG. 2B shows reference clock pulses for driving a semiconductor laser 36. FIG. 2C shows the number of clock pulses in a case where operation is performed according to the reference clock pulses shown in FIG. 2B so as to obtain laser drive pulses shown in FIG. 2A. FIG. 2D shows electrostatic latent images formed on a photosensitive drum 40 with laser drive pulses.

The laser drive pulses output from the pulse-width modulation circuit 35 are supplied to the semiconductor laser 36 to cause the semiconductor laser 36 to emit a laser beam for a period of time corresponding to the pulse width of each of the laser drive pulses. Thus, the semiconductor laser 36 is driven for a relatively long period of time for a pixel having a high density, and for a relatively short period of time for a pixel having a low density.

Thus, for a pixel having a high density, a relatively long part of the photosensitive drum 40, which is an image bearing member, in the main scanning direction that is the longitudinal direction of the photosensitive drum 40 is exposed to a laser beam by an optical system that is described below. Similarly, for a pixel having a low density, a relatively short part of the photosensitive drum 40 in the main scanning direction is exposed to a laser beam.

That is to say, an electrostatic latent image having a dot size (an area to be developed in a pixel) corresponding to the density of each of the pixels to be recorded is generated on the basis of the image density information of an original document. Thus, the amount of toner consumed for a pixel having a high density is larger than that for a pixel having a low density. In FIG. 2D, reference letters L, M, and H denote electrostatic latent images of individual pixels having low, medium, and high densities, respectively, on the photosensitive drum 40.

Optical System

A laser beam 100 emitted from the semiconductor laser 36 enters a rotatable polygon mirror (a polygon mirror) 37. The rotatable polygon mirror 37 is rotated at a constant angular velocity, and the laser beam 100 having entered the rotatable polygon mirror 37 is converted to a deflecting beam the angle of which continuously changes to be reflected in accordance with the rotation of the rotatable polygon mirror 37. The laser beam 100 is further condensed by an f/θ lens group 38. The f/θ lens group 38 further corrects the laser beam 100 for the distortion by converting the constant-angular-velocity movement of the laser beam 100 to a constant-velocity movement on the photosensitive drum 40. A stationary mirror 39 directs the laser beam 100 toward the photosensitive drum 40. The laser beam 100 scans the photosensitive drum 40 at a constant velocity by this operation. Thus, the laser beam 100 scans the photosensitive drum 40 in a direction (the longitudinal direction of the photosensitive drum 40 that is the main scanning direction) substantially parallel to the rotation axis of the photosensitive drum 40 and forms an electrostatic latent image.

The image forming apparatus includes a charging unit that charges an image bearing member, an exposure unit that forms an electrostatic latent image on the charged image bearing member, and a developing unit that develops the electrostatic latent image.

That is to say, the photosensitive drum 40 is a photosensitive body that includes a photosensitive layer made of, for example, amorphous silicon, selenium, or organic photo conductor (OPC) in the surface and rotates in a direction indicated by an arrow. After the electrical charge of the photosensitive drum 40 is uniformly drained by an exposure unit 41, the photosensitive drum 40 is uniformly charged by a primary charger 42 (the charging unit). Then, the photosensitive drum 40 is subjected to exposure scanning (the exposure unit) with the laser beam 100 modulated corresponding to the aforementioned image signals. An electrostatic latent image corresponding to the image signals is formed on the photosensitive drum 40 by this operation. The electrostatic latent image is subjected to reversal developing by a developing unit 43 (the developing unit), and a visible image (a toner image) is formed. The developing unit 43 uses two-component toner that includes a mixture of toner particles and carrier particles.

Reversal developing is a developing method for depositing toner that is charged so as to have the same polarity as a latent image on an area of a photosensitive body exposed to a laser beam to form a visible image. A toner image is transferred, by the function of a transfer charger 49, to transfer material 48 carried by a transfer-material carrying belt 47 that extends between two rollers 45 and 46 and is driven in the direction indicated by the arrow in the drawing.

The transfer material 48, to which the toner image is transferred, is released from the transfer-material carrying belt 47 and conveyed to a fixing unit (not shown), and the toner image is fixed. Subsequently, remaining toner 28 that remains on the photosensitive drum 40 after the transfer operation is reclaimed by a cleaner 50.

Color Image Forming Apparatus

Figure 3:
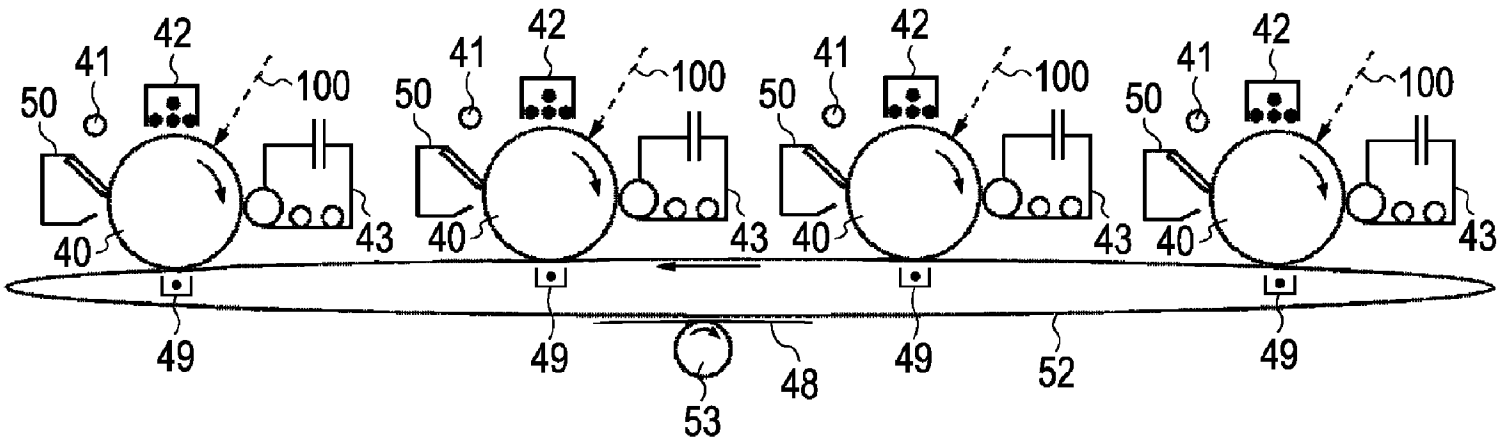
FIG. 3 is a longitudinal sectional view showing the structure of a color image forming apparatus according to another exemplary embodiment of the present invention.

FIG. 3 is a longitudinal sectional view showing the structure of a color image forming apparatus according to another exemplary embodiment of the present invention.

In the color image forming apparatus, for example, image forming units for individual colors of cyan, magenta, yellow, and black are disposed on an intermediate transfer belt 52 along the moving direction of the intermediate transfer belt 52. An electrostatic latent image obtained from an image of the original document by color separation for each of the colors is sequentially formed on the photosensitive drum 40 of each of the image forming stations, and developed by the developing unit 43 having toner of a corresponding color. Then, the electrostatic latent images corresponding to all of the colors are sequentially transferred to the intermediate transfer belt 52. Then, the electrostatic latent images corresponding to all of the colors are transferred to the transfer material 48 by a secondary transfer roller 53 all at once, and a full color image is obtained. In FIG. 3, the same reference numerals as in FIG. 1 are used to denote corresponding components.

The image forming apparatuses according to the exemplary embodiments of the present invention have, for example, a printer function of forming an image sent from a personal computer connected to the image forming apparatuses via a network cable on transfer material such as paper and a facsimile function in addition to the function of copying an original document. That is to say, an image can be formed on the basis of image density information other than a paper original document.

Development Process

Figure 4A:
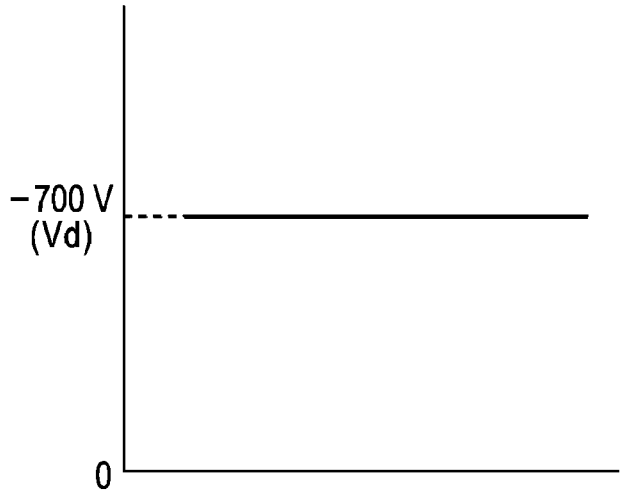
FIGS. 4A, 4B, and 4C show a development process.
Figure 4B:
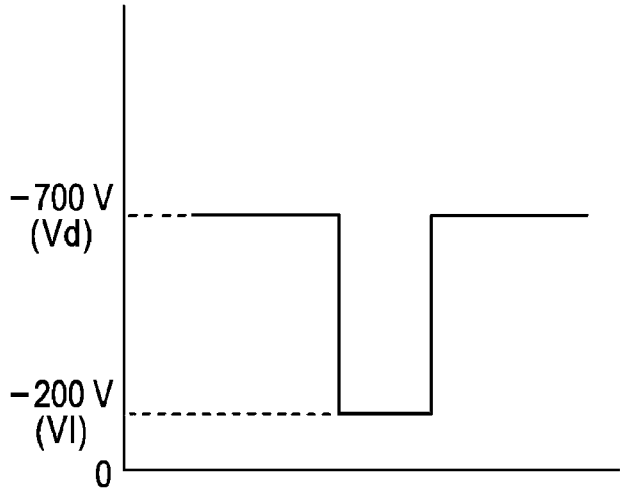
Figure 4C:
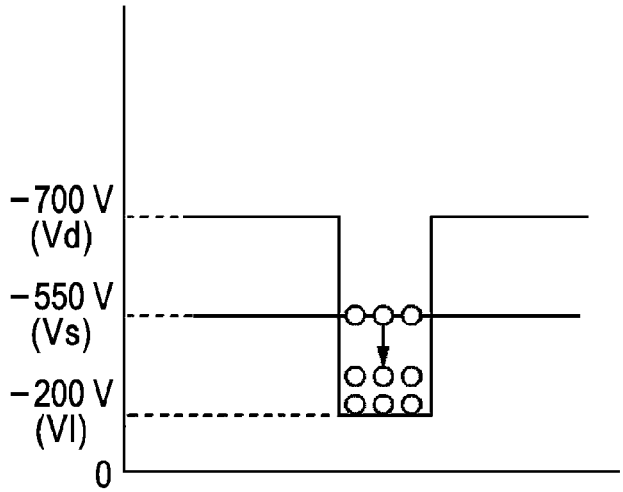

FIGS. 4A, 4B, and 4C show a development process according to an exemplary embodiment. The photosensitive drum 40 is uniformly charged to −700 V (Vd) by the primary charger 42 in FIG. 1, as shown in FIG. 4A, and an electrostatic latent image of −200 V (Vl) is formed on a part irradiated with the laser beam 100, as shown in FIG. 4B.

Reference letters Vd and Vl denote the potential of the surface of the photosensitive drum 40 charged by the primary charger 42 and the potential of a part of the surface of the photosensitive drum 40 that is attenuated by irradiation of the laser beam 100, respectively. When a direct current voltage of −550 V (Vs) is applied to the developing sleeve of the developing unit 43, the electrostatic latent image formed on the photosensitive drum 40 is subjected to reversal developing with negatively charged toner, and a toner image is formed, as shown in FIG. 4C. Then, the back face of the transfer material 48 is positively charged by the transfer charger 49, so that the toner image is transferred to the transfer material 48, and a desired image can be obtained on the transfer material 48 (the transfer material 48 in the foregoing description corresponds to the intermediate transfer belt 52 in the apparatus shown in FIG. 3).

Electrostatic Latent Image

Figure 5:
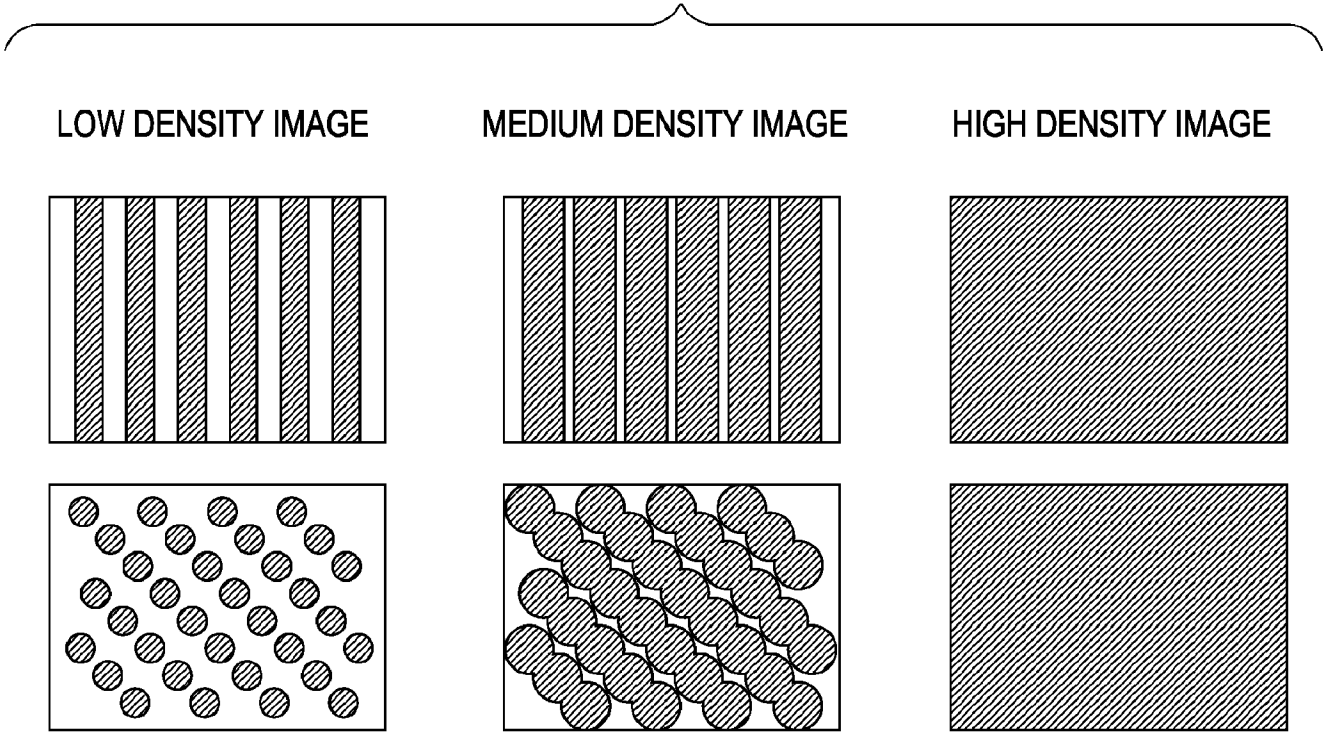
FIG. 5 shows electrostatic latent images formed on a photosensitive drum.

FIG. 5 shows electrostatic latent images formed on the photosensitive drum in an exemplary embodiment. The cycle (representing the number of times a laser beam is emitted per inch and hereinafter being expressed with dpi being the unit) of laser drive pulses, the spot diameters of the laser beam 100, or the like is changed to express individual image densities (a low density image, a medium density image, and a high density image). In general, in the case of a low density image, a corresponding electrostatic latent image is composed of isolated dots or lines, as shown in FIG. 5. When the state of an image is close to that of a medium density image, each of the isolated dots is formed so as to occupy a relatively large area. Thus, each of the isolated dots is in contact with adjacent dots, and each of the lines is expressed as a relatively bold line. Moreover, in the case of a high density image, the image cannot be recognized as an image that is composed of isolated dots or lines.

FIGS. 6A and 6B show, in detail, an exemplary case where a latent image of the eighty-fifth level of 256-level (0 to 255 levels) tone reproduction is formed in an exemplary embodiment. It is assumed that the image forming apparatus according to an exemplary embodiment can form an image with a resolution of 600 dpi in the main scanning direction by 600 dpi in the sub scanning direction. The smallest square in the drawing represents a unit pixel (in this case, a pixel in an image with a 600-dpi resolution), and each side of the square has a length of 42 μm. Within a unit pixel, the semiconductor laser 36 emits a laser beam during 0%-100% of dwell time per pixel. However, the semiconductor laser 36 cannot perform an on/off operation of the laser more than once. For example, the following on/off operation of the laser cannot be performed for a unit pixel: The laser is first turned on during 30% of dwell time per pixel, off during 50% of dwell time per pixel, and then again on during 20% of dwell time per pixel. A unit pixel represents the minimum area (in this case, a pixel in an image with a 600-dpi resolution, each side of the pixel having a length of 42 μm) within which a laser can be turned on just once. The spot diameters of the semiconductor laser 36 used in this case are assumed to be 43 μm and 50 μm.

FIG. 6B shows the percentage of time during which the semiconductor laser 36 is driven to emit a laser beam onto each unit pixel to dwell time per pixel. In this case, the laser beam 100 emitted from the semiconductor laser 36 scans the photosensitive drum 40 from left to right (the longitudinal direction of the photosensitive drum 40) in the drawing. In a case where a certain pixel is scanned, when the semiconductor laser 36 continuously emits the laser beam 100, "100%" is displayed for the pixel. In FIG. 6A, the percentage of time during which the laser beam 100 is emitted onto each pixel to dwell time per pixel is visually expressed by an area painted in black. The latent image of the eighty-fifth level is generated from these pieces of data.

FIG. 7 shows a case where electrostatic latent images are formed on the photosensitive drum 40 with the spot diameters of the semiconductor laser 36, which is used, being 43 μm and 50 μm on the basis of data shown in FIGS. 6A and 6B. Parts painted in black show parts, the potential (corresponding to reference letter Vl in FIG. 4B) of which being reduced by being exposed to the laser beam 100 emitted from the semiconductor laser 36. Since a spot formed by the laser beam 100, the diameters of which being 43 μm and 50 μm, is larger than a unit pixel, each side of which having a length of 42 μm, as shown in FIG. 7, the electrostatic latent images corresponding to pixels scanned by the laser beam 100 are in contact with (overlap) each other regardless of emission time. Thus, no space exists between the generated electrostatic latent images. However, when the laser beam 100 does not scan some pixels, electrostatic latent images corresponding to pixels scanned by the laser beam 100 are not in contact with each other. Thus, spaces exist between the electrostatic latent images.

The potential of the photosensitive drum 40 is reduced by exposure scanning with the laser beam 100. However, the relationship between a reduction in the potential of the photosensitive drum 40 and an increase in the amount of exposure to the laser beam 100 is nonlinear. As the amount of exposure increases, the potential is reduced less. In this case, the potential of electrostatic latent images is less sensitive to a change in the amount of exposure. Utilizing this characteristic, latent images are concentrated such that the degree of concentration of the latent images is higher than that of latent images obtained when the same density is obtained in an analog fashion so as to generate highly stable electrostatic latent images that do not depend on a change in the amount of laser beam using a part of the photosensitive drum 40 having a low potential.

Figure 8:
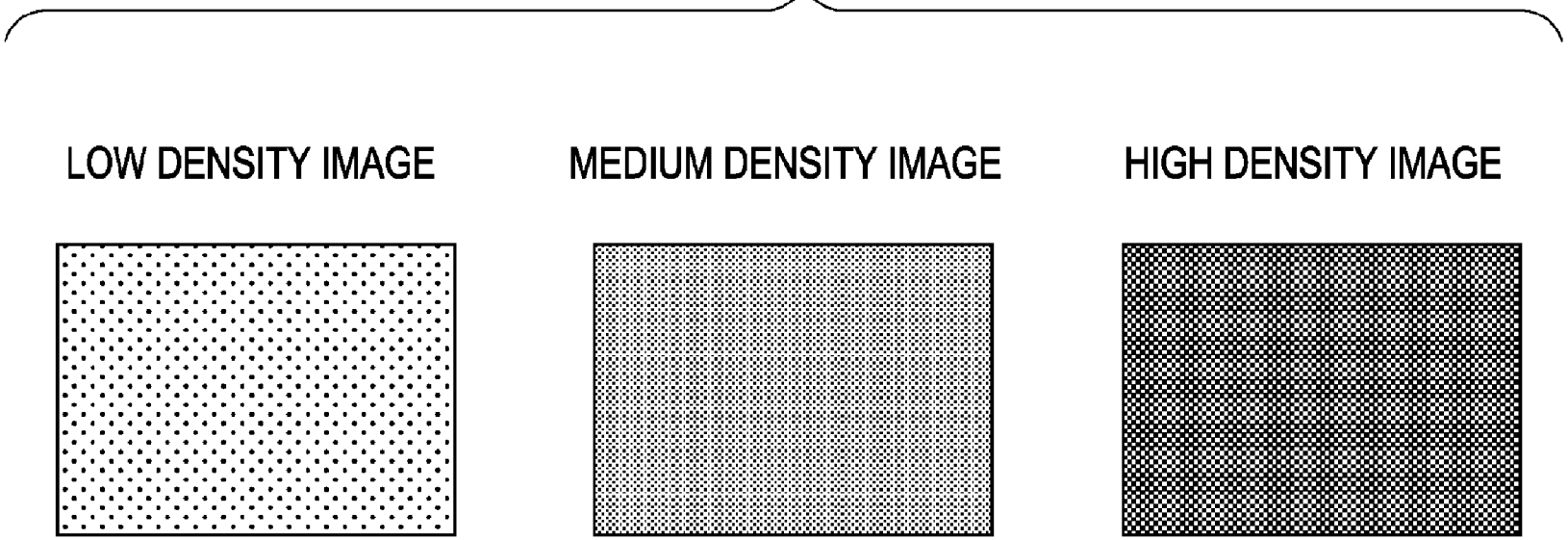
FIG. 8 shows that uniform electrostatic latent images are generated when the electrostatic latent images are generated in an analog fashion.

On the other hand, when electrostatic latent images are formed in an analog fashion, the image density can be controlled by, for example, changing the potential Vl or changing the contrast potential (V) so as to change the potential Vs in FIGS. 4B and 4C. In this manner, uniform electrostatic latent images are formed, as shown in FIG. 8. In general, an analog-like electrostatic latent image in which the dots tend to be unstable, excluding a part filled with a color, is formed using a range of potentials in which the potential of the electrostatic latent image is sensitive to the amount of laser beam. Thus, unevenness or change in the density is likely to occur. This may cause a problem with development. Thus, in general, an image is generated using an electrostatic latent image composed of isolated dots or lines in a range in which the dots are illegible to the user. However, when the contrast potential is determined by the aforementioned method for controlling the stability of a high density range, an electrostatic latent image composed of isolated dots or lines cannot be used. This will be described next.

Correlation Between Contrast Potential (V) and Image Density

Figure 9:
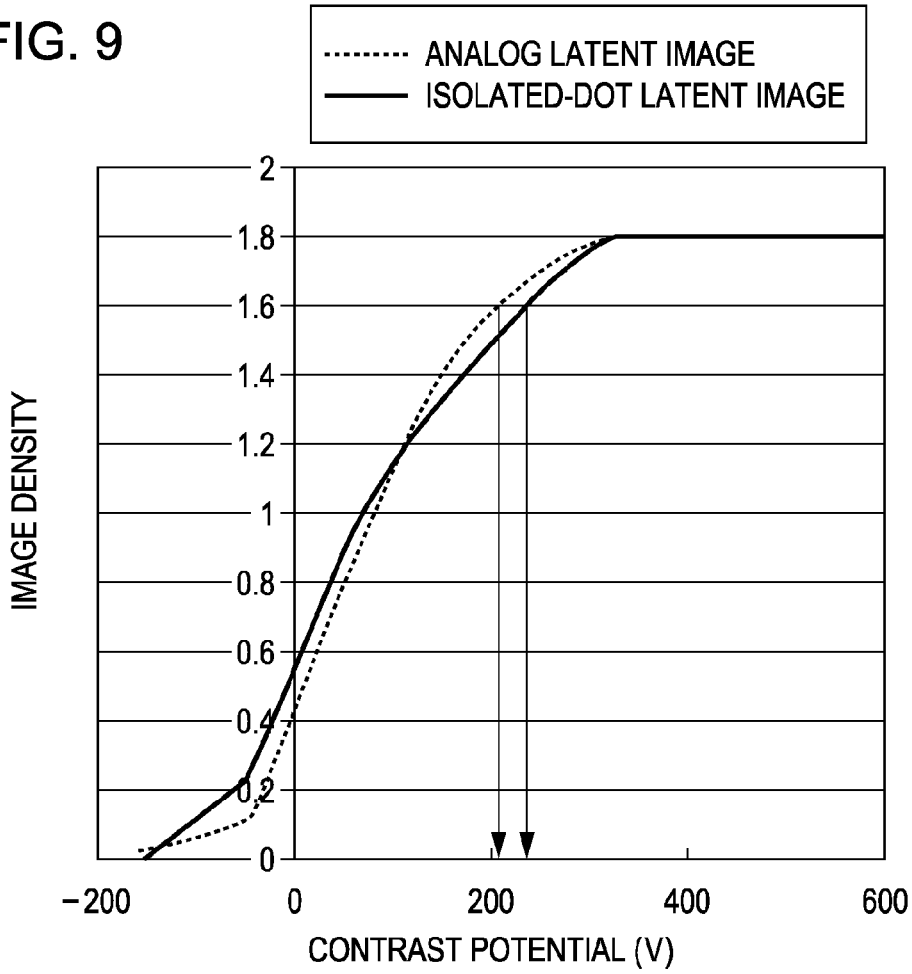
FIG. 9 shows the correlations between the contrast potential and the image density in a case where an electrostatic latent image is formed in an analog fashion and another case where an electrostatic latent image is formed with isolated dots.

FIG. 9 shows the correlations between the contrast potential (V) and the image density in a case where an electrostatic latent image is formed in an analog fashion and another case where an electrostatic latent image is formed with isolated dots. The contrast potential (V) represents the difference between the reading of a potential sensor 51 shown in FIG. 1 and the developing bias Vs. In the case of an electrostatic latent image formed with isolated dots, the potential of the electrostatic latent image is the reading of the potential sensor 51 monitoring a segment that includes a part Vl that is exposed to a laser beam and a part Vd that is not exposed to a laser beam, i.e., a value corresponding to the ratio between the areas of the parts Vl and Vd.

The correlation between the contrast potential (V) and the image density in the case of an analog latent image is different from that in the case of a latent image composed of isolated dots, as shown in FIG. 9. In this case, it is assumed that a latent image is generated, in which 133 lines of spaces exist between lines of dots per inch when halftone is expressed with dots. The spot diameters of the laser are described below.

When a control process for determining the contrast potential so as to obtain a desired high density image depends on a method for generating an electrostatic latent image, an electrostatic latent image corresponding to an image to be generated should be used so as to perform precise control. In general, a high density range need not be generated with isolated dots. Even when a latent image is generated in a digital fashion with a laser beam, since a part filled with a color is generated, the latent image is generated as an analog-like electrostatic latent image. Thus, when a contrast potential for obtaining a desired high density image is determined, an analog-like electrostatic latent image needs to be generated. As is apparent from FIG. 9, in a range of high densities of 1.7 or more, the isolated-dot latent image is generated as an analog-like latent image because dots in the isolated-dot latent image are in contact with (connect with) each other. Thus, when a contrast potential for achieving a density of 1.7 or more is determined, no problem occurs. However, when a control process is performed for determining a contrast potential with which a desired high density image can be obtained, image generation is performed with a relatively large contrast potential because the desired high density image needs to be output reliably. In this case, since high density image signals with which isolated dots are generated such that the isolated dots are in contact with each other are not necessarily used, an inappropriate contrast potential may be set, as shown in the drawing. Thus, when a control process is performed for determining a contrast potential with which a desired high density image can be obtained, an electrostatic latent image is formed such that isolated dots are not generated. In known methods, patch images are generated by, for example, changing the primary charging bias so as to change Vd, or changing the developing bias so as to change Vs, and the correlation between the potential and the density is obtained. However, it takes a long time to perform this operation, and it is hard to integrate a plurality of patches into one image. Thus, a plurality of image density patches should be generated by controlling the laser. However, in this case, isolated dots are generated, as described above. Thus, in the present invention, this problem is solved by optimizing the cycle (dpi) of laser drive pulses, the spot diameters of the laser, and the like.

Spot Diameter

Figure 10:
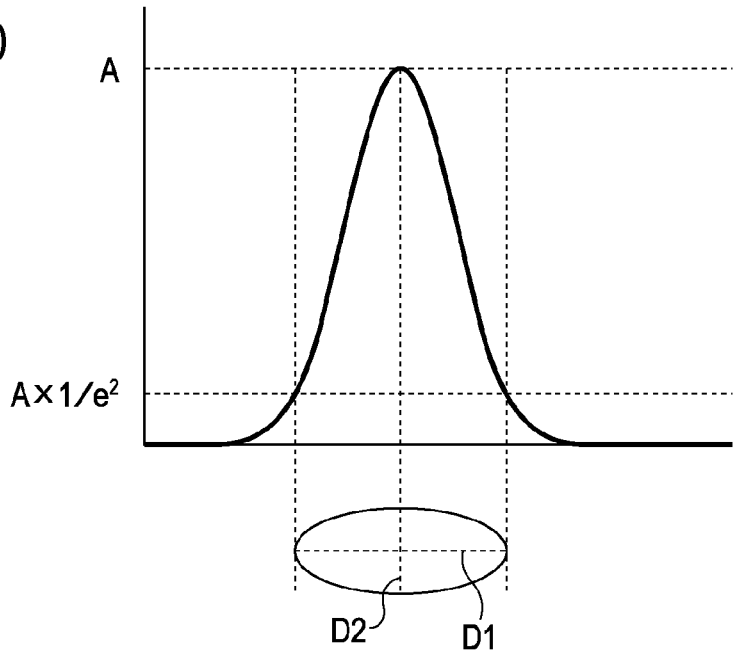
FIG. 10 shows a method for measuring the spot diameters of a beam spot.

The laser according to an exemplary embodiment, in particular, the spot diameters, will now be described in detail. FIG. 10 shows a method for measuring the spot diameters (Di [μm]) of a beam spot in the present invention. In the present invention, the spot diameters of a beam spot are defined by a part in which the intensity of the beam is at least $A \times 1/e^2$ where A is the peak intensity. A typical distribution of intensities is the Gaussian distribution or the Lorentz distribution.

The spot diameters of a beam spot are measured at nine points obtained by dividing an area on which an image is formed into eight sub-areas in the longitudinal direction, and the averages of values measured at the nine points are obtained as the spot diameters (Di [μm]) of the beam spot.

In many cases, a beam spot is elliptical in shape, as shown in FIG. 10. In the present invention, the minimum values of a spot diameter D1 in the main scanning direction (the longitudinal direction) and a spot diameter D2 in the sub scanning direction (the circumferential direction) are obtained as the spot diameters of a beam spot at each of the points of measurement so that an electrostatic latent image is not composed of isolated dots.

In the present invention, the spot diameter D1 in the main scanning direction and the spot diameter D2 in the sub scanning direction of a beam spot are measured with a beam analyzer manufactured by Melles Griot Inc.

In the measurement, the spot diameter D1 of 43 μm and the spot diameter D2 of 50 μm are used in the present invention because, in the image forming apparatus used in the present invention, an image can be formed with a resolution of 600 dpi by 600 dpi, and each side of a unit pixel has a length of 42 μm.

Figure 11:
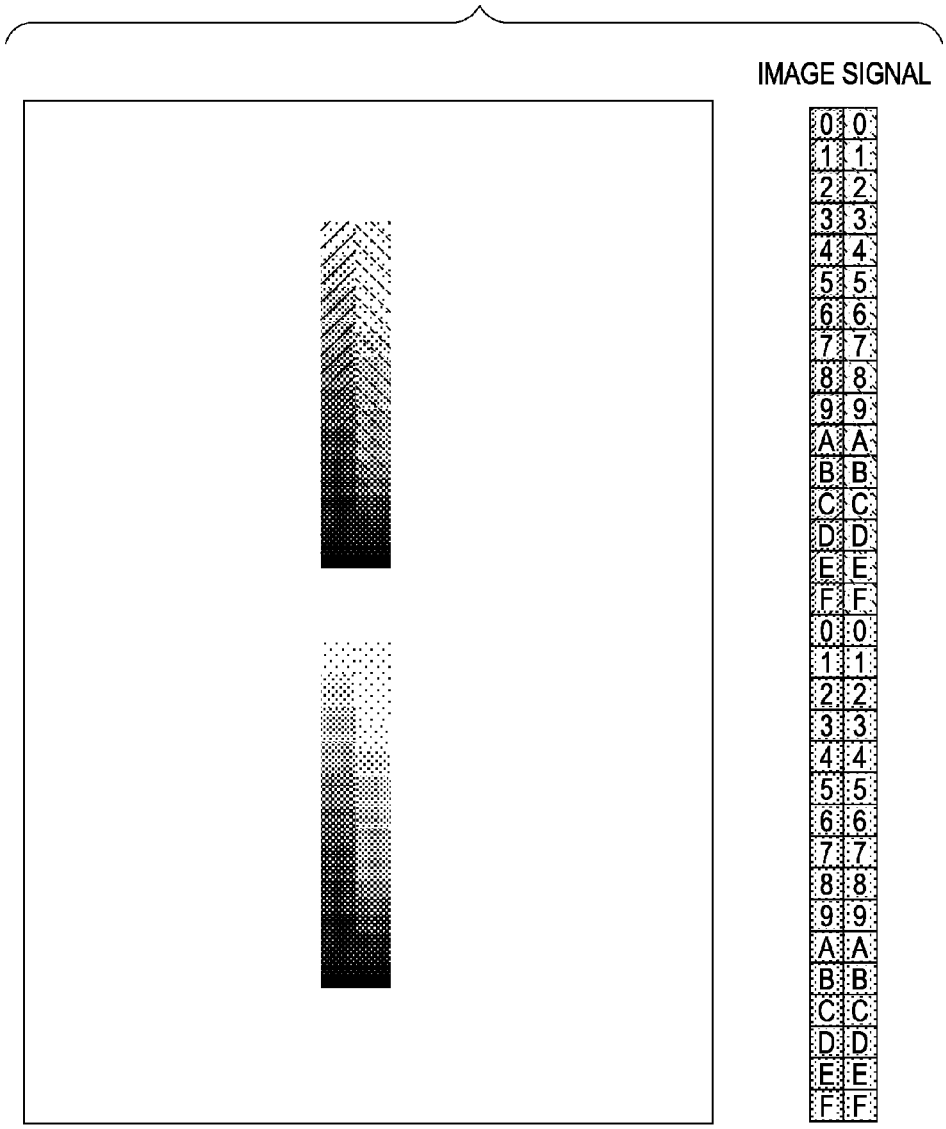
FIG. 11 shows an image in a case where a control process is performed to determine a contrast potential with which a high density image can be obtained.

FIG. 11 shows an image in a case where a control process is performed to determine a contrast potential with which a high density image can be obtained. The left side of the drawing shows an image, and the right side shows image signal levels. Each of the image signal levels indicates a laser signal level in a corresponding pixel and a laser emission width (emission time). A level F is the maximum image signal level, and the other levels are uniformly assigned such that the amount of light is linear. In this case, the resolution is 600 dpi. In this exemplary embodiment, even when the image signal level in a pixel is the level F, the laser emits a laser beam onto the pixel during 70% of the dwell time on the pixel, not all of the dwell time. This is because a case where a delay occurs in stopping emitting a laser beam is considered. However, the present invention is not limited to this exemplary embodiment.

Figure 12A:
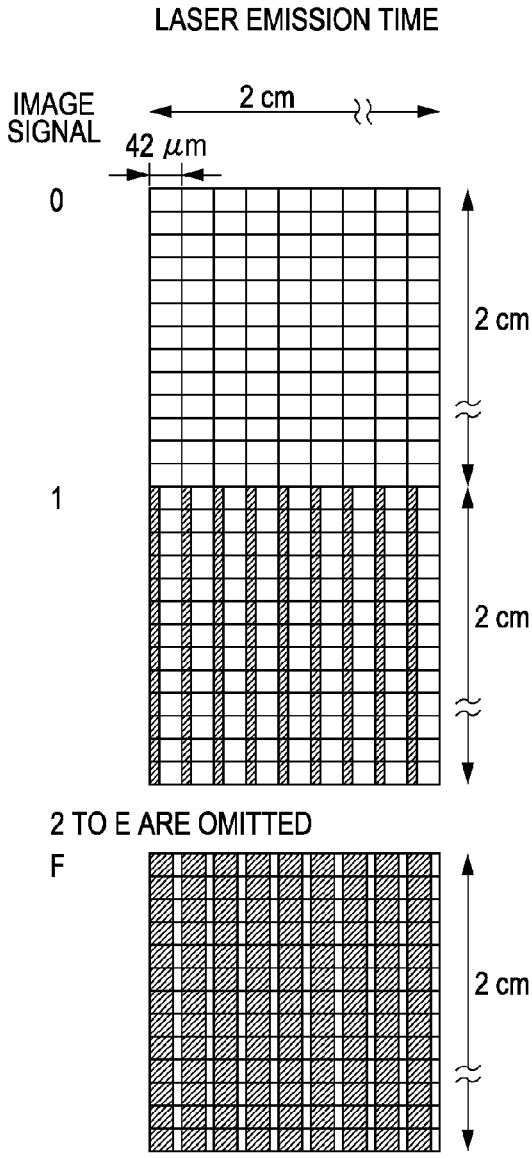
FIG. 12A shows image signals.
Figure 12B:
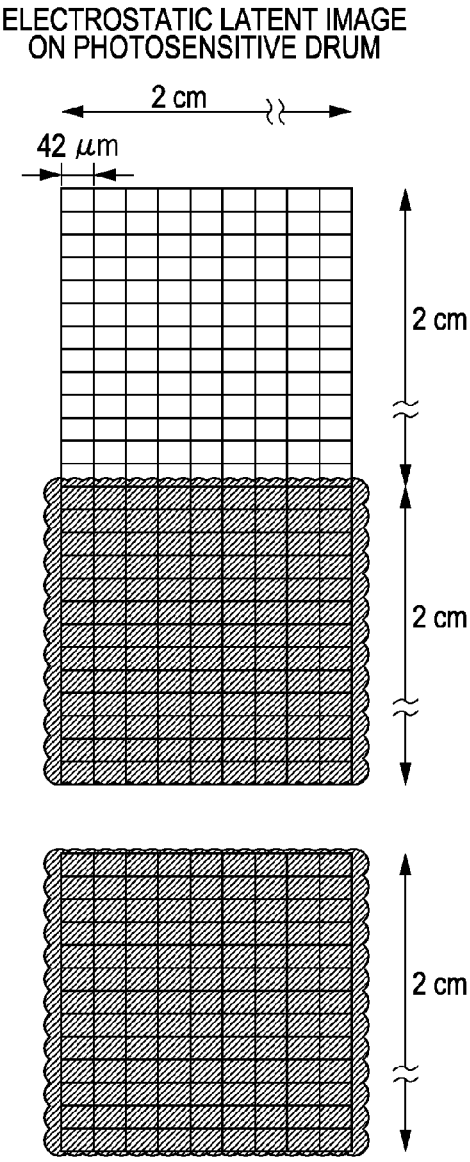
FIG. 12B shows corresponding electrostatic latent images.

FIGS. 12A and 12B show image signals and electrostatic latent images in a case where images are formed with the aforementioned spot diameters of the laser, as described above.

As is apparent from FIGS. 12A and 12B, even when image signals correspond to isolated dots, as shown in FIG. 12A, electrostatic latent images formed on the photosensitive drum 40 are not composed of isolated dots and are generated as analog-like images, as shown in FIG. 12B. This arrangement can be implemented when a laser beam spot is larger than a pixel. In the strict sense, diffusion by the surface layer of the photosensitive drum 40 and the like may affect this arrangement. However, in general, when this relationship is satisfied, an analog-like electrostatic latent image can be obtained.

The potential sensor 51 measures the potential of each of such electrostatic latent images to obtain a contrast potential, and, for example, a scanner reads each of the aforementioned images and converts the read data to a density. A contrast potential with which a desired density can be achieved can be determined on the basis of this relationship. Known methods can be used to set a primary charging bias and a developing bias with which the contrast potential is obtained.

Figure 14:
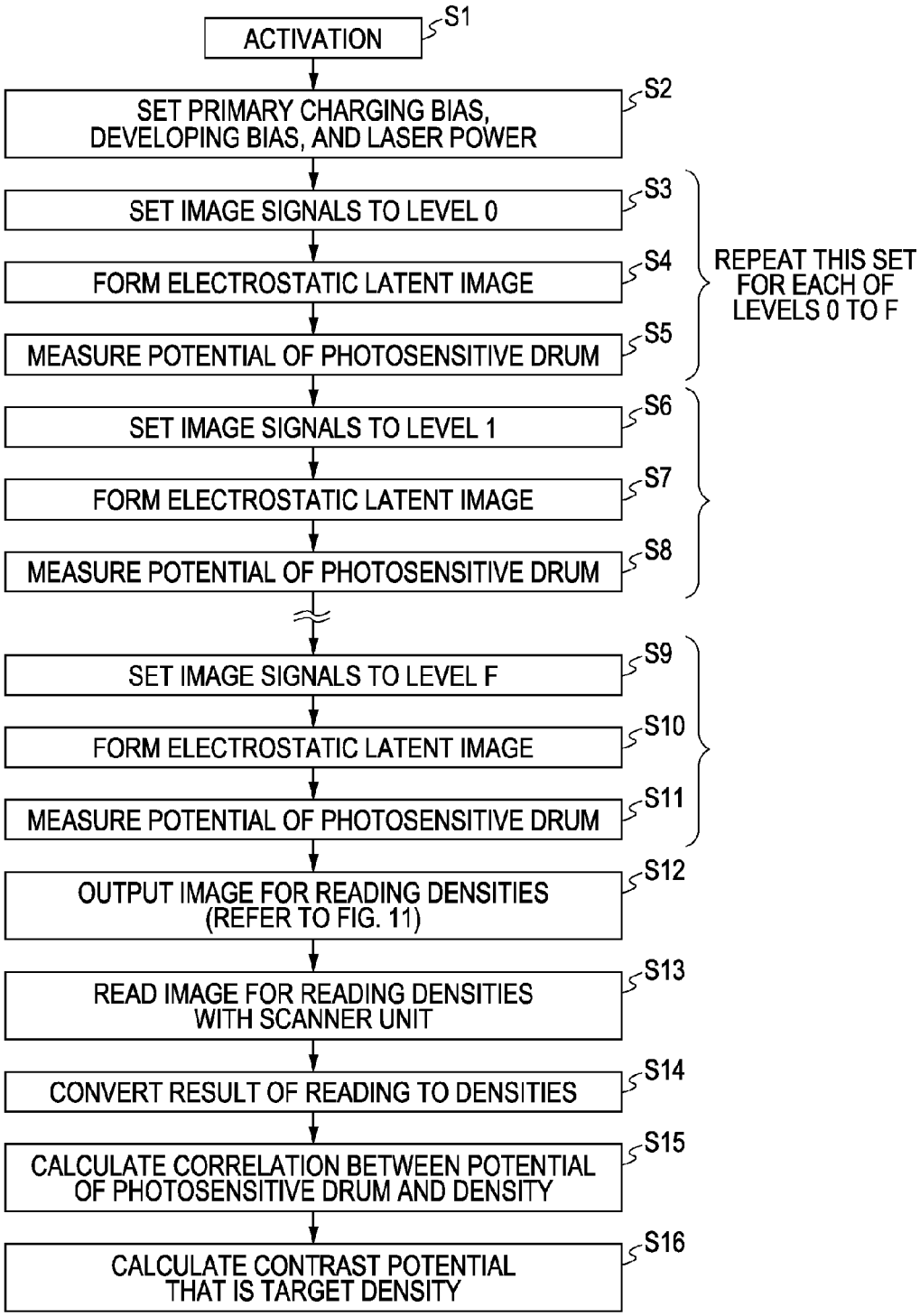
FIG. 14 is a flowchart of a process of obtaining a contrast potential.

FIG. 14 is a flowchart showing the details of a control process of obtaining a contrast potential. This control process is activated in response to instructions sent from a user when the user needs to adjust the image density. Specifically, in step S1, the user sends instructions for adjusting the density from, for example, a touch panel (not shown) included in the image forming apparatus. After the control process is activated in step S1, in step S2, a primary charging bias, a developing bias, and a laser power for adjustment are set, the values of which are higher than values used when regular image formation is performed.

Then, in step S3, the level of image signals is set to a level 0. In step S4 (a forming step), an electrostatic latent image is formed with a resolution of 600 dpi. In step S5 (a measuring step), the potential of the photosensitive drum 40 is measured with the potential sensor 51. Then, in step S6, the level of image signals is set to a level 1. In step S7 (a forming step), an electrostatic latent image is formed. In step S8 (a measuring step), the potential of the photosensitive drum 40 is measured with the potential sensor 51. Then, the foregoing process is repeated to sequentially form an electrostatic latent image for each of the levels 0 to F, and the potential sensor 51 measures the potential of the electrostatic latent image (steps S9 to S11).

In this case, the primary charging bias, the developing bias, and the laser power are set, the values of which are higher than values used when regular image formation is performed, so as to reliably obtain a target density (in this case, 1.6) in this control process. Specifically, in this exemplary embodiment, the contrast potential is 100 V higher than a regular potential, and the maximum laser power is used.

Subsequently, in step S12, the image shown in FIG. 11 is formed on the transfer material 48 and output. Then, in step S13, the image is read as the original document 31 by the image pickup element 33, for example, a CCD, via the lens 32 in the scanner section. Then, in step S14 (a density detecting step), image densities are detected on the basis of the read data.

Figure 13:
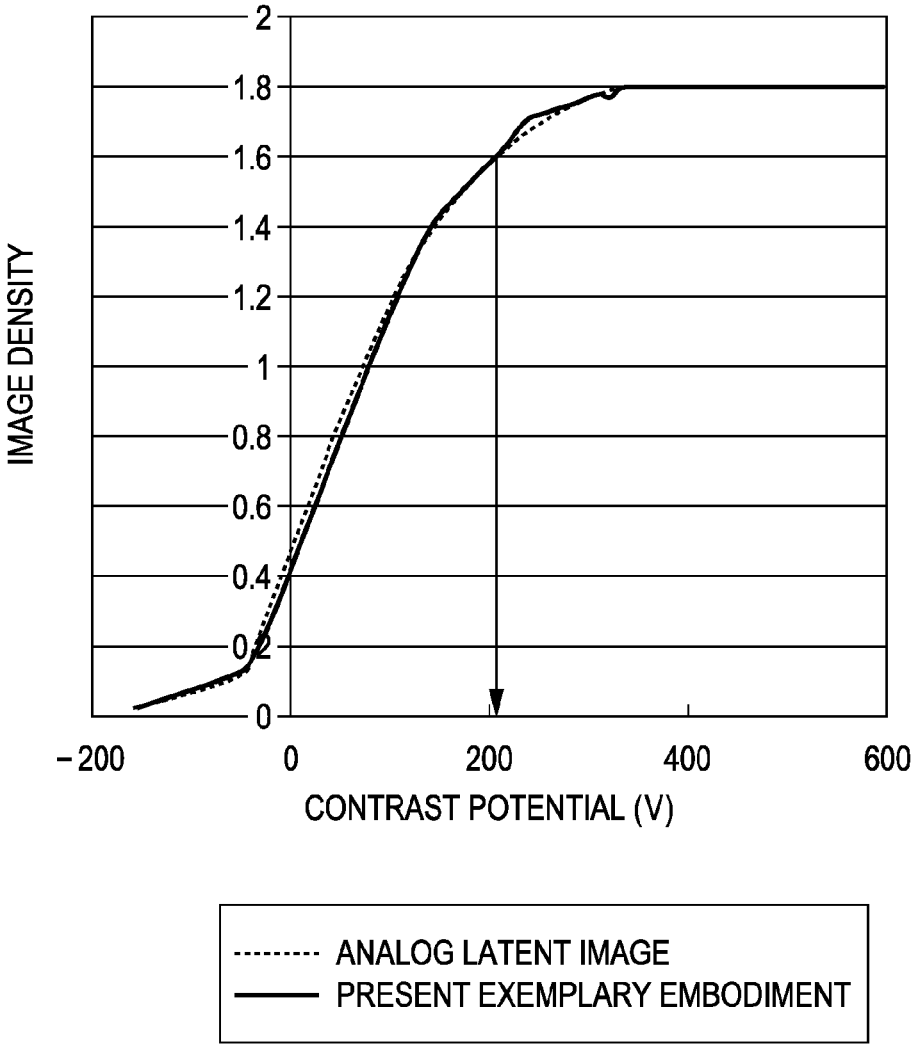
FIG. 13 shows the correlations between the contrast potential and the image density.

FIG. 13 shows the correlation between the contrast potential (V) and the image density in this case. In step S15, the correlation between the potential of the photosensitive drum 40 and the density is calculated. Then, in step S16 (a control step), a contrast potential that is a target density is calculated. For comparison, FIG. 13 also shows the correlation between the contrast potential (V) and the image density in the case of an analog latent image that is obtained by changing the primary charging bias and the developing bias.

As is apparent from the drawing, the correlation between the contrast potential (V) and the image density in this exemplary embodiment is similar to the correlation between the contrast potential (V) and the image density in an analog latent image, and a satisfactory result is obtained.

Subsequently, after a primary charging bias and a developing bias are determined by a known method, a tone patch may be generated, and the tone may be adjusted by correcting, for example, a look-up table.

An electrostatic latent image that is not composed of isolated dots can be formed with a laser beam spot that is larger than a unit pixel, as described above. A potential can be set, considering the characteristics of the image forming apparatus, by obtaining the correlation between the potential of such an electrostatic latent image and the density from a plurality of patches. Moreover, since patches at more than one level are not generated by changing the charging bias or the developing bias, patch images can be integrated into a minimum number of images (in this case, one image). Thus, a plurality of sheets of paper need not be output, and the control process can be performed in a short time.

A plurality of correlations between density patches and development contrasts faithfully representing the developing characteristics of the image forming apparatus can be obtained in a short time by controlling the emission time, considering the spot diameters of the laser, without changing the charging bias, the developing bias, and the like. Appropriate setting values of the charging bias and the developing bias can be obtained from the correlations, thus enabling satisfactory control of a high density range.

The present invention is also achieved by an embodiment in which a storage medium that stores program code (software) that performs the functions according to the foregoing exemplary embodiments is provided to a system or a device and a computer (or a central processing unit (CPU), a micro processing unit (MPU), or the like) included in the system or the device reads and executes the program code stored in the storage medium.

In this case, the program code read from the storage medium performs the functions according to the foregoing exemplary embodiments.

The following media can be used as storage media that are used to supply the program code: for example, a floppy disk, a hard disk, a magneto-optical disk, an optical disk, such as a compact disc recordable (CD-R), a CD rewritable (CD-RW), a digital versatile disk read only memory (DVD-ROM), a DVD random access memory (DVD-RAM), a DVD-RW, or a DVD rewritable (DVD+RW), a magnetic tape, a nonvolatile memory card, and a ROM. Alternatively, the program code may be downloaded via networks.

Moreover, an operating system (OS) operating on a computer may execute some or all of the actual processing to perform the functions of the foregoing exemplary embodiments according to instructions from the program code.

Moreover, the program code read from the storage medium may be written to a memory included in, for example, a function expansion board inserted in a computer or a function expansion unit connected to a computer. Then, for example, a CPU included in the function expansion board, the function expansion unit, or the like may execute some or all of the actual processing to perform the functions of the foregoing exemplary embodiments according to instructions from the program code.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2006-105383 filed Apr. 6, 2006 and No. 2007-016426 filed Jan. 26, 2007, which are hereby incorporated by reference herein in their entirety.

What is claimed is:

1. An image forming apparatus comprising:

an image bearing member;

a charging unit configured to charge the image bearing member by applying charging bias to the image bearing member;

an exposure unit configured to irradiate the image bearing member with a laser beam so as to form an electrostatic latent image on the image bearing member charged by the charging unit;

a driving unit configured to supply a pulse signal to a light source so that the exposure unit emits the laser beam;

a pattern forming unit configured to have the charging unit, the exposure unit and the driving unit form a plurality of latent image patterns of potential levels different from each other in order to control the density of a toner image to be formed on the image bearing member;

a control unit configured to control the charging bias and developing bias to be kept constant and change a pulse width of the pulse signal when forming the plurality of latent image patterns in order to control a potential difference between the electrostatic latent image and the developing bias to be a predetermined value;

a developing unit configured to apply the developing bias to a toner and develop the plurality of latent image patterns with the toner;

a measuring unit configured to measure potentials of the plurality of latent image patterns; and a density detecting unit configured to detect the density of the plurality of predetermined toner patterns, wherein the control unit controls the pulse width of the pulse signal so that exposure areas formed with one pulse signal and adjacent to each other are overlapped when the plurality of latent image patterns are formed on the image bearing member, and wherein the control unit controls at least one of the charging bias and the developing bias based on a measurement result of the measuring unit and a detection result of the density detecting unit so that the potential difference between the electrostatic latent image and the developing bias is controlled to be predetermined value.

2. The image forming apparatus according to claim 1, wherein the control unit is configured to control the pulse width of the pulse signal so that an area where the latent image patterns are formed does not have a part that is not exposed.

3. The image forming apparatus according to claim 1, wherein the exposure unit is configured to expose an area larger than one pixel with the laser beam, and wherein the control unit is configured to control the pulse width of the pulse signal so that the area larger than one pixel is exposed.

* * * * *